US006874723B2

(12) United States Patent
Ueyama et al.

(10) Patent No.: US 6,874,723 B2
(45) Date of Patent: Apr. 5, 2005

(54) CONTROL METHOD FOR WINDING

(75) Inventors: Minoru Ueyama, Katano (JP); Toshinari Ishida, Takatsuki (JP)

(73) Assignee: Fuji Tekko Co., Ltd., Neyagawa (JP)

( * ) Notice: Subject to any disclaimer, the term of this patent is extended or adjusted under 35 U.S.C. 154(b) by 52 days.

(21) Appl. No.: 10/314,544

(22) Filed: Dec. 9, 2002

(65) Prior Publication Data

US 2004/0108403 A1 Jun. 10, 2004

(51) Int. Cl.[7] ..... B65H 18/08
(52) U.S. Cl. ..... 242/530.3; 242/413.9
(58) Field of Search ..... 242/412, 412.2, 242/413, 413.9, 414.1, 415, 416, 418, 420.5, 523, 530.3, 530.4, 545.1, 554.5

(56) References Cited

U.S. PATENT DOCUMENTS 3,372,320 A * 3/1968 Boyum et al. ..... 242/414.1
3,603,521 A * 9/1971 Ormsby ..... 242/413
3,982,710 A * 9/1976 Teumer ..... 242/412.2
4,166,590 A * 9/1979 Dennhardt ..... 242/414.1
5,060,881 A * 10/1991 Bogucki-Land ..... 242/418
5,178,341 A * 1/1993 Ditto ..... 242/412.2
5,697,573 A * 12/1997 Fukuchi et al. ..... 242/412.2
5,909,855 A * 6/1999 Jorkama et al. ..... 242/414.1
6,158,687 A * 12/2000 Widmer ..... 242/413.9

* cited by examiner

*Primary Examiner*—William A. Rivera
(74) *Attorney, Agent, or Firm*—Flynn, Thiel, Boutell & Tanis, P.C.

(57) ABSTRACT

A winding apparatus, such as a slitter rewinder, designed to shorten a distance between an unwinding shaft and a winding shaft, thereby downsizing the apparatus and attaining a significant cost reduction. To that end, in unwinding a web from the unwinding shaft, either to wind it onto the winding shaft or to slit it in the elongate direction into plural narrow-width webs and separate them alternately vertically or longitudinally, followed by winding onto respective winding shafts, the unwinding shaft is driven at a preset web speed, the winding shaft is driven at a preset web tension, guide rollers for guiding the web are disposed between the unwinding and winding shafts to thereby leave the guide rollers to rotate freely by contact with the web without their direct driving.

4 Claims, 2 Drawing Sheets

CONTROL METHOD FOR WINDING

BACKGROUND OF THE INVENTION

1. Field of the Invention

This invention generally relates to a method for controlling the winding of a winding apparatus, wherein a web is payed out from an unwinding shaft and wound up onto a winding shaft and, in particular, to a control method for winding of a slitter rewinding apparatus, wherein a wide web is slit and separated into a plurality of narrow-width webs and wound up.

2. Description of Related Art

As a winding apparatus for winding up a web payed out from an unwinding shaft onto a winding shaft, a slitter rewinder has been heretofore known and received a wide practical acceptance, wherein a wide web is slit in the elongate direction into a plurality of narrow-width webs and the narrow-width webs thus slit are separated alternately vertically (upwardly and downwardly) or longitudinally (fore and aft) and wound onto respective winding shafts disposed in upper and lower positions or in forward and rearward positions. The control of winding with such a conventional slitter rewinder, as generally illustrated in FIG. 1, is carried out in a manner that from an unwind roll R0 on an unwinding shaft, on which a brake 31 is fitted, a web W is unwound at a preset web speed under rotation of take-off rollers 20, 30 by means of a motor M2, the preset speed being set with a speed setting unit 37, the motor M2 being controlled with a control amplifier 36, wherein the tension required for the unwinding of the web is controlled by means of the brake 31 through a control amplifier 32 by matching a tension (variable) detected by means of a tension detector 35 fitted on an unwinding roller 1 with a definite unwinding tension set by means of an unwinding tension setting unit 34 on a computing unit 33.

The web thus unwound by means of the take-off rollers 20, 30 is slit with a slitter blade 4 into a plurality of narrow-width webs, which are in turn wound via touch rollers 5 onto respective winding shafts of a wind-up roll R1. At that time, the winding operation is controlled by multiplying a movement distance (variable) of the touch roller 5 detected with a roll radius detector 41 and a definite tension set on a tension setting unit 40 on a torque computing unit 39, transmitting a torque value thus obtained to a torque-controllable motor M1 through a control amplifier 38 for the motor, whereby to control the motor M1. In FIG. 1, only one winding shaft is indicated for simplicity.

Stated another way, the conventional control method for winding has been conducted by disposing the brake (31) at an unwinding position, the motor (M2) for driving the take-off rollers at a take-off position, and the motor (M1) capable of controlling torque at a winding position, in combination.

However, the take-off rollers at the take-off position are required to tension the web at the unwinding position by a suitable tension force, which necessitates satisfying a variety of important conditions involving complicated factors such as a friction force between the web and the roller surface, a web embracing amount of each of the take-off rollers, the number of take-off rollers installed, etc.

Further, the take-off position is tensioned under a tension necessary for winding of the web from the winding position, but such a web take-off roller unit that is free from being dragged by the tension is required.

In the conventional control system, it is thus necessary and indispensable that the web be tensioned by a necessary tension and the take-off roller unit do not slip even if tensioned from the winding position.

In order to grapple with the problems mentioned above, this invention has been made by investigating particularly into a drive system of a winding apparatus, and it is an object of this invention to do away with the need of the aforesaid take-off roller unit and its drive device at the take-off position by providing free rotating guide rollers that are necessary in a minimum number for the winding or slitting-rewinding of a web and accordingly, to shorten a distance between the unwinding shaft and the winding shaft, thereby downsizing the winding apparatus and enabling a significant cost reduction.

SUMMARY OF THE INVENTION

The invention for attaining the foregoing object is first addressed to a control method for winding on a winding apparatus, wherein a web is payed out from an unwinding shaft to be wound up on a winding shaft; and the method is characterized in that the unwinding shaft is driven at a preset web running speed to thereby pay out the web, the winding shaft is driven under a preset web tension thereby to wind up the web, and guide rollers are disposed between the unwinding and winding shafts in place of positive driving take-off rollers and are left in free rotation by contact with the web without resort to positive driving.

The invention as claimed is also directed to an embodiment where the first invention is applied particularly to a slitter rewinding apparatus, wherein a wide web unwound from an unwinding shaft is slit in the elongate direction into a plurality of narrow-width webs, which are in turn separated alternately vertically or longitudinally and wound onto respective winding shafts disposed in upper and lower positions or forward and rearward positions. The method is characterized in that the unwinding shaft is driven by means of a motor capable of controlling its revolution so as to revolve at a preset web running speed thereby to pay out the web, the winding shafts are each driven with a motor capable of controlling a winding tension, thereby to wind each of the narrow-width webs; and guide rollers for guiding the web are disposed between the unwinding shaft and the winding shaft in place of take-off rollers depending on direct driving, the guide rollers being left in a free rotation by contact with the web without resort to direct driving.

In the foregoing inventions, it is a preferred embodiment that instead of the torque-controllable motor for the winding shaft, a friction type of winding shaft capable of controlling a torque be used as a winding shaft and be controlled by means of a revolution speed-controllable motor while rotating the friction type winding shaft in an overdriving manner. Here, the term "overdriving" used throughout this invention means that the winding shaft is controlled by the motor to rotate at a higher speed than that of a winding core around the shaft thereby to absorb the slip of the winding shaft to the winding core.

BRIEF DESCRIPTION OF THE DRAWINGS

Specific embodiments of this invention will be hereinafter described in more detail with reference to the accompanying drawings, in which.

DESCRIPTION OF THE PREFERRED EMBODIMENTS

Figure 2:
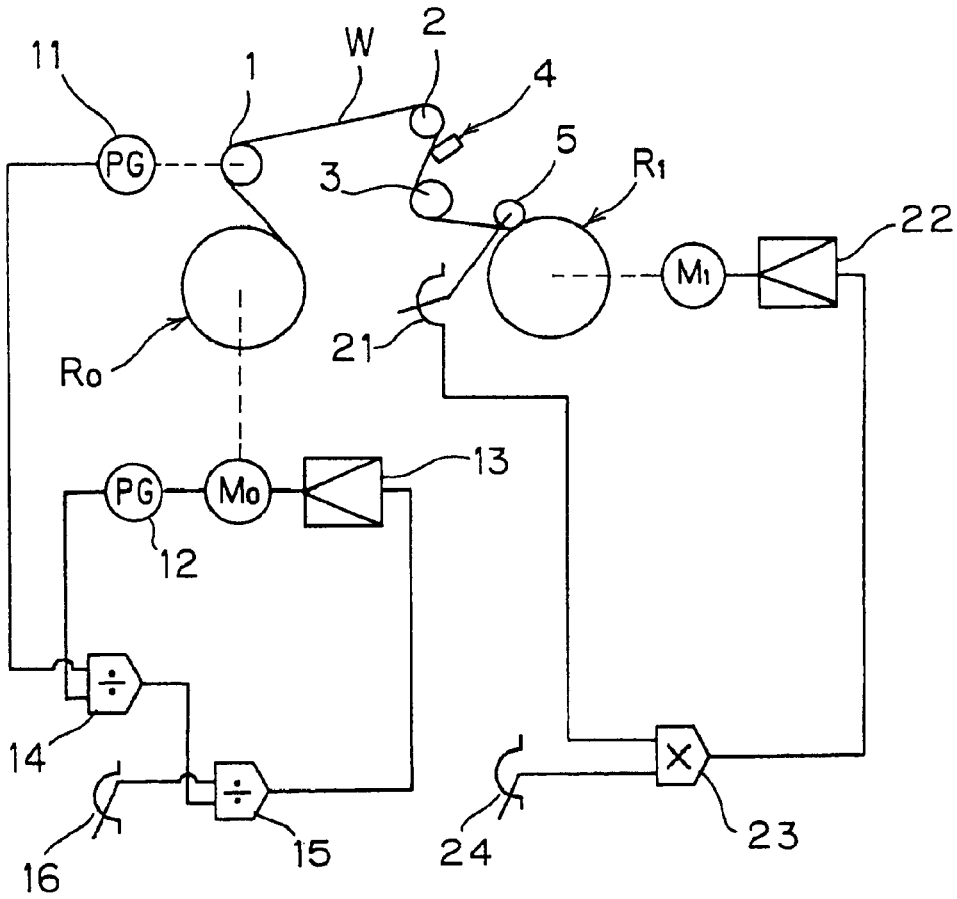
FIG. 2 is a schematic illustration showing a winding control system according to this invention.

FIG. 2 indicates schematically a driving system in a typical slitter rewinding apparatus for carrying a winding control method pertaining to this invention into effect. In the figure, the reference characters R0 and R1 designate an unwind roll and a wind-up roll, respectively. On that slitter rewinding apparatus, a wide web W is payed out from the unwind roll R0, fitted on an unwinding shaft, through an unwind roller 1 and slit between guide rollers 2, 3 with a slitter blade 4 in the elongate direction into a plurality of narrow-width webs, which are in turn separated alternately upwardly and downwardly or forwardly and rearwardly and wound onto winding shafts disposed above and below or in front and rear positions by making a touch roller 5 contact with each of the winding shafts as the wind rolls R1, as is the case with a conventional slitter rewinding apparatus.

The driving system for conducting the winding control of this invention is characterized by the modes for controlling the unwinding shaft and the winding shaft in the aforementioned apparatus. For the unwinding shaft on the unwind roll R0 side, an unwinding motor M0 capable of controlling its revolution is employed. At the unwind roller 1 a detecting sensor pulley of a web speed detector 11 is brought into abutment with the web surface to detect a web speed, which is matched with and divided by a revolution number detected with the aid of a revolution number detector 12 for detecting the revolution of the motor M0 on a roll radius computing unit 14 to obtain a value, which is further matched and divided with a preset speed set with a speed setting unit 16 on a revolution number computing unit 15. From these matching results obtained, the unwinding shaft is adapted to control the revolution of the unwinding motor M0 through a motor control amplifier 13 in this way.

Figure 1:
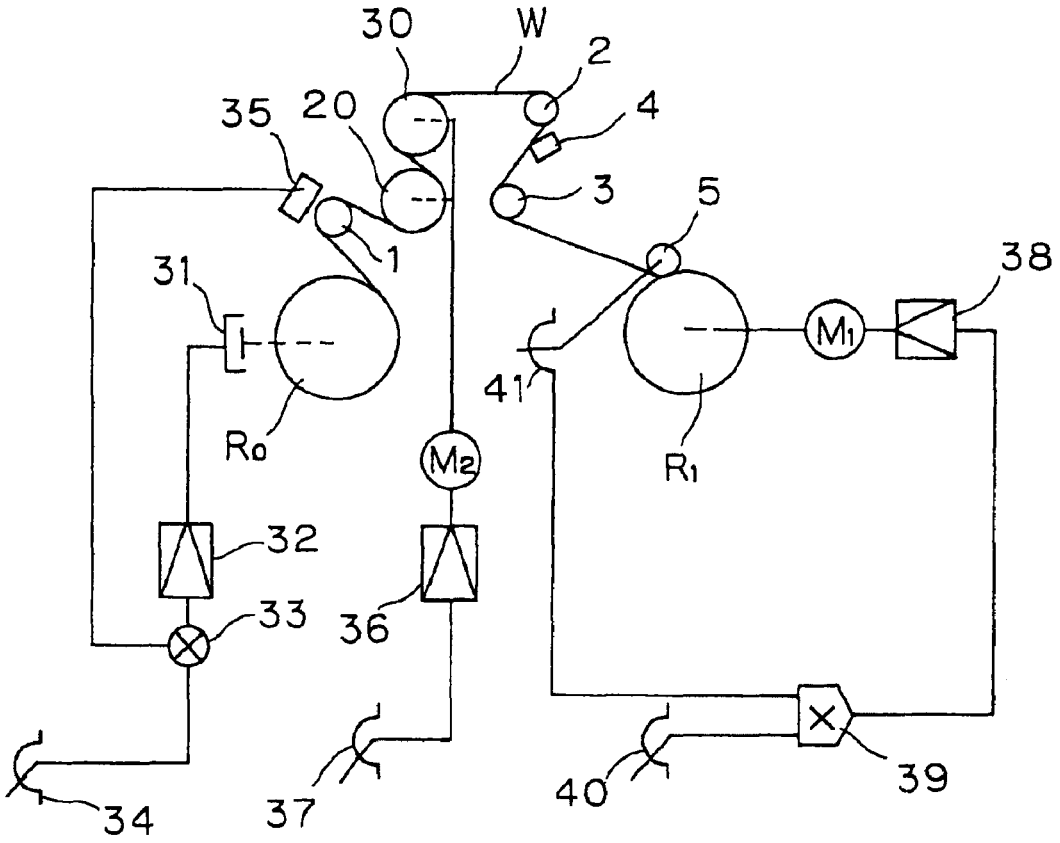
FIG. 1 PRIOR ART
FIG. 1 is a schematic view similarly showing a winding control system according to a conventional method.

On the other hand, the winding shaft for forming the wind-up roll R1 is driven by means of a winding motor M1 capable of controlling a torque. The motor M1 is controlled, similarly to the case with the winding control shown in FIG. 1. That is, a value detected with a roll radius detector 21 through the touch roller 5 in pressure contact with the wind roll R1 is multiplied with a preset web tension set with a tension setting unit 24 on a torque computing unit 23 to obtain a computing result, on the basis of which the motor M1 is controlled through a motor control amplifier 22. In FIG. 2, only one winding shaft is indicated for brevity.

To sum up, respective motors of the unwinding shaft and the winding shaft are controlled and driven on the basis of a preset web speed and a preset web tension, respectively, whereby a winding control in winding the web on the unwinding shaft onto the winding shaft is achieved.

By the winding control described above, the take-off mechanism, which has been necessary in the conventional control system, can be dispensed with, and it is possible to perform a successful winding operation only by the provision of the free-rotating guide rollers to the least limit in number without the necessity of taking various conditions coupled with the aforesaid mechanism into consideration.

In the description above, the torque-controllable motor is used as a motor for driving the winding shaft in order to control the torque of the winding shaft. However, it is also possible to combine a friction type of winding shaft capable of controlling its torque and a revolution speed-controllable motor for rotating the friction type of winding shaft in an overdriving manner, in place of the torque-controllable motor above, whereby a similar effect can be attained.

The foregoing description is made for a slitter rewinder, but it is naturally possible to apply this invention to a winder (simple rewinder) where a web is unwound from a stock web roll and rewound as wind-up rolls.

As described above, this invention provides, in a winding apparatus wherein a web is unwound from an unwinding shaft and wound onto a winding shaft, a control method characterized by driving the unwinding shaft at a preset web speed, driving the winding shaft at a preset web tension, and providing guide rollers for guiding the web between the unwinding and winding shafts to drive the guide rollers while making them rotate freely by contact with the web without resort to their direct driving. Thus the take-off mechanism (take-off roller unit and its driving unit) necessitated in the prior art winding control is dispensed with and accordingly, various parameters involved in the take-off mechanism, e.g. the friction force of the web with the take-off rollers, the web embracing amount of the take-off rollers, the number of necessary take-off rollers, etc. need not be considered. By the provision of the guide rollers only, the distance between the unwinding shaft and the winding shaft is shortened, to enable downsizing of the apparatus and a vast cost reduction.

In particular, a slitter rewinder is desired to be easy to operate and compact since its shop processes have been operated generally in a small-scale factory by nonskilled workers. This invention can satisfy such conditions as a slitter rewinder.

What is claimed is:

1. A method for controlling the winding of a web on a winding apparatus comprising an unwinding shaft provided at an upstream side of the web for paying out the web, a winding shaft provided on a downstream side of the web for winding up the web and guide rollers interposed between the unwinding shaft and winding shaft for guiding and feeding the web, said method comprising the steps of: maintaining a preset running speed of the web while paying the web out from the unwinding shaft and pulling the web under a tension by the winding shaft; allowing the web to run along the guide rollers while the guide rollers freely rotate and winding the web onto the winding shaft while maintaining the web at a preset web tension.

2. The method of claim 1, wherein the winding shaft is a friction winding shaft capable of controlling its torque and the winding step is conducted under the preset web tension while controlling the revolution of the friction winding shaft at a present overdrive revolution number by means of a revolution-controllable motor.

3. A method for controlling the winding of a web on a slitter rewinding apparatus comprising an unwinding shaft for paying a wide web out, a slitter for slitting the wide web in an elongate direction and separating the slit wide web alternately vertically or longitudinally into a plurality of narrow-width webs, respective winding shafts for winding up the narrow-width webs either upward and downward or fore and aft, disposed in this order, and guide rollers interposed between the unwinding shaft and winding shafts for guiding the web, the slitter being interposed between the guide rollers, said method comprising the steps of: maintaining a preset running speed of the web by means of a revolution-controllable motor while paying the web out from the unwinding shaft and pulling the web under a tension by each of the respective winding shafts; allowing the web to run along the guide rollers while the guide rollers freely rotate; and winding the web onto each of the respective winding shafts while maintaining the web at a preset web tension by means of a torque-controllable motor.

4. A method of controlling the winding of a web on a slitter rewinding apparatus comprising an unwinding shaft for paying a wide web out, a slitter for slitting the wide web in an elongate direction and separating the slit wide web alternately vertically or longitudinally into a plurality of narrow-width webs, respective friction winding shafts for winding up the narrow-width webs either upward and downward or fore and aft, disposed in this order, and guide rollers interposed between the unwinding shaft and friction winding shafts for guiding the web, the slitter being interposed between the guide rollers, and the friction winding shafts being torque-controllable, said method comprising the steps of maintaining a preset running speed of the web by means of a revolution-controllable motor while paying the web out from the unwinding shaft and pulling the web under a tension by each of the respective friction winding shafts; allowing the web to run along the guide rollers while the guide rollers freely rotate; and winding the web onto each of the respective friction winding shafts while controlling the friction winding shafts under a preset web tension and a preset overdrive revolution number by means of a revolution-controllable motor.

* * * * *